US008213814B2

(12) United States Patent
Yamane

(10) Patent No.: US 8,213,814 B2
(45) Date of Patent: Jul. 3, 2012

(54) IMAGE FORMING APPARATUS

(75) Inventor: Tsutomu Yamane, Tokyo (JP)

(73) Assignee: Oki Data Corporation, Tokyo (JP)

( * ) Notice: Subject to any disclaimer, the term of this patent is extended or adjusted under 35 U.S.C. 154(b) by 85 days.

(21) Appl. No.: 12/782,121

(22) Filed: May 18, 2010

(65) Prior Publication Data

US 2010/0296826 A1 Nov. 25, 2010

(30) Foreign Application Priority Data

May 22, 2009 (JP) ..... 2009-124637

(51) Int. Cl.
*G03G 15/06* (2006.01)

(52) U.S. Cl. ..... 399/44; 399/43

(58) Field of Classification Search ..... 399/43, 399/44, 49, 228, 281
See application file for complete search history.

(56) References Cited

U.S. PATENT DOCUMENTS

2004/0105689 A1 * 6/2004 Shimura et al. ..... 399/12

FOREIGN PATENT DOCUMENTS

| | | | | |
|---|---|---|---|---|
| JP | 10-333435 | A | | 12/1998 |
| JP | 2002258609 | A | * | 9/2002 |
| JP | 2004-177928 | A | | 6/2004 |
| JP | 2006-154562 | A | | 6/2006 |
| JP | 2007-248489 | A | | 9/2007 |
| JP | 2007248489 | A | * | 9/2007 |

* cited by examiner

*Primary Examiner* — David Gray
*Assistant Examiner* — Billy J Lactaoen
(74) *Attorney, Agent, or Firm* — Marvin A. Motsenbocker; Mots Law, PLLC

(57) ABSTRACT

An image forming apparatus includes: an image carrier on which an electrostatic latent image is formed; a developer carrier being in contact with the image carrier and configured to develop the electrostatic latent image on the image carrier with a developer; a temperature humidity measurement unit configured to measure the temperature and humidity around the developer carrier; a pressure changing mechanism configured to change a pressure of a contact between the image carrier and the developer carrier; and a pressure controller operable to change, based on the temperature and humidity measured by the temperature humidity measurement unit, the pressure by controlling the pressure changing mechanism.

12 Claims, 10 Drawing Sheets

| HUMIDITY \ TEMPERATURE | LESS THAN 15°C | 15°C OR MORE |
|---|---|---|
| 0% OR MORE BUT LESS THAN 30% | SETTING A | SETTING A |
| 30% OR MORE BUT LESS THAN 40% | SETTING A | SETTING B |
| 40% TO 100% | SETTING B | SETTING B |

IMAGE FORMING APPARATUS

CROSS REFERENCE TO RELATED APPLICATIONS

This application claims priority based on 35 USC 119 from prior Japanese Patent Application No. P2009-124637 filed on May 22, 2009, entitled "Image Forming Apparatus", the entire contents of which are incorporated herein by reference.

BACKGROUND OF THE INVENTION

1. Field of the Invention

The invention relates to an image forming apparatus such as a printer or a copier of an electrophotographic type.

2. Description of the Related Art

Conventional image forming apparatus operate as follows. Specifically, an electrostatic latent image is formed on a surface of a photosensitive drum uniformly charged by a changing apparatus, by exposing the surface of the photosensitive drum to light from an exposure apparatus. The electrostatic latent image is developed with a development roller of a developing apparatus being in contact with the photosensitive drum to thereby form a toner image on the photosensitive drum. Thereafter, the toner image is transferred and fixed onto a recording medium. Meanwhile, after the transfer of the toner image, untransferred toner remaining on the photosensitive drum is removed with a cleaning blade.

Some of such image forming apparatus prevent failure to clean untransferred toner from the photosensitive drum by changing the timing of contact and separation of the development roller with and from the photosensitive drum on the basis of a temperature detected by a sensor (For example, Japanese Patent Application Publication No. 2006-154562 (paragraphs [0056] to [0061], and FIG. 6)).

SUMMARY OF THE INVENTION

In the conventional technique as described above, the nip amount between the photosensitive drum serving as an image carrier and the development roller serving as a developer carrier is constant. In a high-temperature and high-humidity environment, the development roller may absorb moisture thereby increasing its electrical conductivity and thus resulting in charge leakage from the toner. Conversely in a low-temperature and low-humidity environment, the development roller conductivity decreases thereby reducing the toner discharge rate. Hence, the toner charge on the development roller becomes unstable. For this reason, there is a problem that deterioration of image quality such as fog and smear occurs depending on environmental conditions such as temperature and humidity.

An object of the invention is to suppress such deterioration of image quality due to environmental conditions.

An aspect of the invention is an image forming apparatus including: an image carrier on which an electrostatic latent image is formed; a developer carrier in contact with the image carrier and configured to develop the electrostatic latent image on the image carrier with a developer; a temperature humidity measurement unit configured to measure the temperature and humidity around the developer carrier; a pressure changing mechanism configured to change the pressure of contact between the image carrier and the developer carrier; and a pressure controller operable to change the pressure by controlling the pressure changing mechanism based on the temperature and humidity measured by the temperature humidity measurement unit.

According to the aspect, deterioration in image quality with change in environmental conditions is suppressed.

DETAILED DESCRIPTION OF THE EMBODIMENTS

Figure 1:
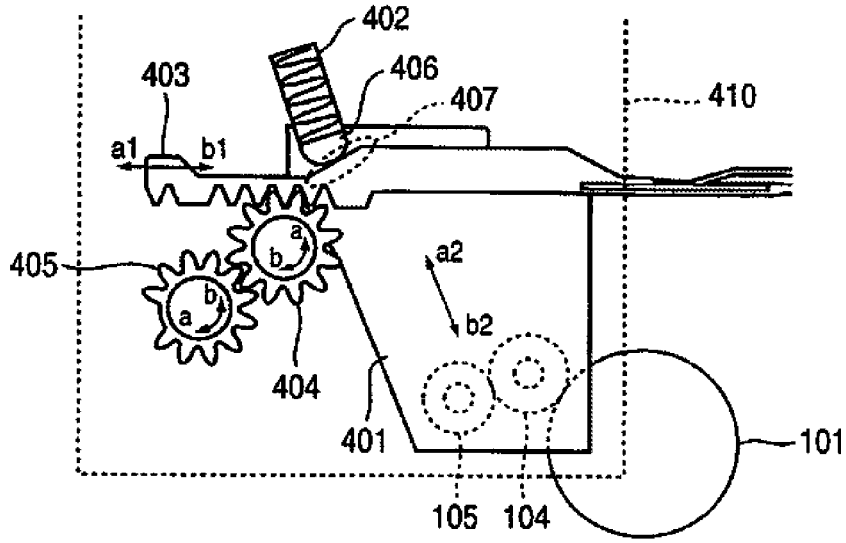
FIG. 1 is a schematic diagram of a development roller pressure changing unit of a first embodiment.

Descriptions are provided herein below for embodiments based on the drawings. In the respective drawings referenced herein, the same constituents are designated by the same reference numerals and duplicate explanation concerning the same constituents is omitted. All of the drawings are provided to illustrate the respective examples only.

Hereinafter, embodiments of an image forming apparatus of the invention are described with reference to the drawings.

First Embodiment

Figure 2:
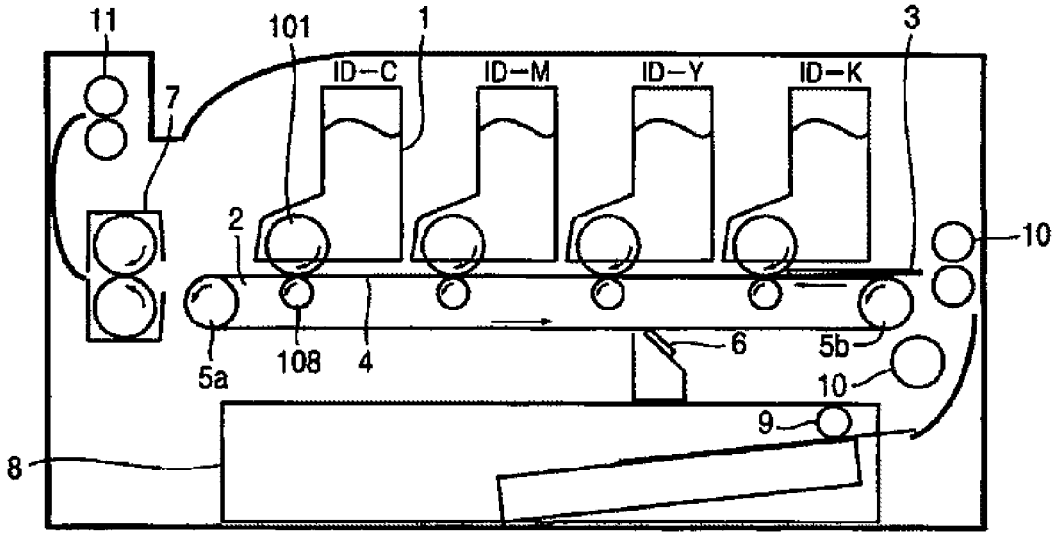
FIG. 2 is a schematic diagram of an image forming apparatus of the first embodiment.

FIG. 2 is a schematic diagram of an image forming apparatus of the first embodiment. In the description of this embodiment, the image forming apparatus is a color printer of an electrophotographic type.

In FIG. 2, multiple image drums 1 are provided in the image forming apparatus. In this embodiment, image drums ID-K, ID-Y, ID-M, and ID-C are arranged in this order from upstream at substantially regular intervals, and correspond to toners of color black, yellow, magenta, and cyan, which serve as developers. These image drums 1 have the same structure. Note that, the structure of image drums 1 is described later.

Image transfer belt unit 2 includes image transfer members 108 such as image transfer rollers, image transfer belt 4 serving as an image transfer member, and conveying rollers 5*a* and 5*b* configured to drive image transfer belt 4. Image transfer belt unit 2 is configured to transfer toner images developed on image drums 1 onto recording medium 3.

Image transfer belt cleaning device 6 removes untransferred toner from image transfer belt 4 for cleaning.

Sheet feed tray 8 houses recording media 3. Recording medium 3 is conveyed, by feed roller 9 and conveying rollers 10, from sheet feed tray 8 to image transfer belt 4. While recording medium 3 is transferred by image transfer belt 4, toner images formed by image drums 1 are transferred onto recording medium 3.

Then, fixing unit 7 including a heat roller and a backup roller fixes the toner image to recording medium 3. Thereafter, recording medium 3 is discharged by discharge roller 11 out of the image forming apparatus.

Figure 3:
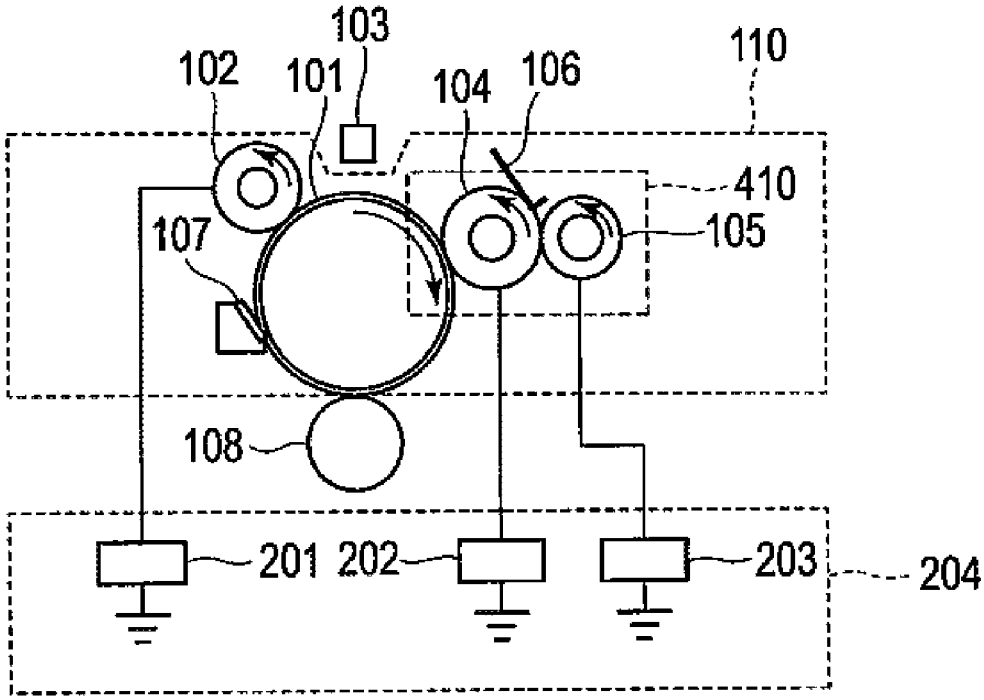
FIG. 3 is a schematic diagram of an image drum of the image forming apparatus of the first embodiment.

FIG. 3 is a schematic diagram of an image drum of the image forming apparatus of the first embodiment.

Image drum 1 shown in FIG. 3 is configured to form an image on photosensitive drum 101 serving as an image carrier. Image drum 1 includes photosensitive drum 101 serving as an image carrier, charging roller 102 serving as a charging member, exposure unit 103, development roller 104 serving as a development member or a developer carrier, supplying roller 105 serving as a supplying member, toner regulating member 106, cleaning device 107, image transfer member 108, charging roller power source 201, development roller power source 202, supplying roller power source 203, and development roller pressure changing unit 410.

Components including these photosensitive drum 101, charging roller 102, exposure unit 103, development roller 104, supplying roller 105, toner regulating member 106, and cleaning device 107 are collectively referred to as image forming unit 110.

Power sources including charging roller power source 201, development roller power source 202, and supplying roller power source 203 are collectively referred to as power source unit 204.

Photosensitive drum 101 is an organic photoreceptor. Photosensitive drum 101 includes an electrically conductive support and a photoconductive layer on the surface of the electrically conductive support. The electrically conductive support is an aluminum metal pipe. The photoconductive layer is formed by stacking a charge generation layer and a charge transport layer.

Charging roller 102 is formed of a metal shaft and a semiconducting rubber layer formed on a surface of the metal shaft. Charging roller 102 is disposed in contact with photosensitive drum 101. Charging roller 102 is configured to charge uniformly and homogeneously the surface of photosensitive drum 101.

Exposure unit 103 includes a Light Emitting Diode (LED) device, an LED driving device, and a lens array. Exposure unit 103 exposes the surface of photosensitive drum 101, charged by charging roller 102, to light emitted from the LED device thereby forming an electrostatic latent image on the surface of photosensitive drum 101.

Development roller 104 is formed of a metal shaft, a semiconducting urethane rubber member, and the like. Development roller 104 is disposed in contact with photosensitive drum 101. Development roller 104 carries toner, and develops the electrostatic latent image formed on the surface of photosensitive drum 101, thereby forming a toner image on the surface of photosensitive drum 101.

Supplying roller 105 is formed of a metal shaft, a foamed silicone rubber material, and the like. Supplying roller 105 is disposed in contact with development roller 104. Supplying roller 105 charges toner, and supplies the charged toner to development roller 104.

Toner regulating member 106 is formed of a plate-shaped member of stainless steel or the like, and disposed with an edge portion in slight contact with development roller 104. That is, toner regulating member 106 is in contact with a surface of development roller 104 and thus meters the toner supplied from supplying roller 105 to form a thin layer of the toner on development roller 104.

Cleaning device 107 is formed of a rubbery elastic member such as a polyurethane rubber. The rubbery elastic member serving as cleaning device 107 is disposed in contact with the outer peripheral surface of photosensitive drum 101 while facing in a direction opposing the rotation direction of photosensitive drum 101. Cleaning device 107 removes toner which is not transferred onto recording medium 3 but remains on the surface of photosensitive drum 101.

Image transfer member 108 is formed of a foamed elastic rubber member. Image transfer member 108 is disposed facing photosensitive drum 101, with the conveying path for conveying recording medium 3 interposed therebetween. Image transfer member 108 transfers developed toner on the surface of photosensitive drum 101 onto conveyed recording medium 3.

Figure 6:
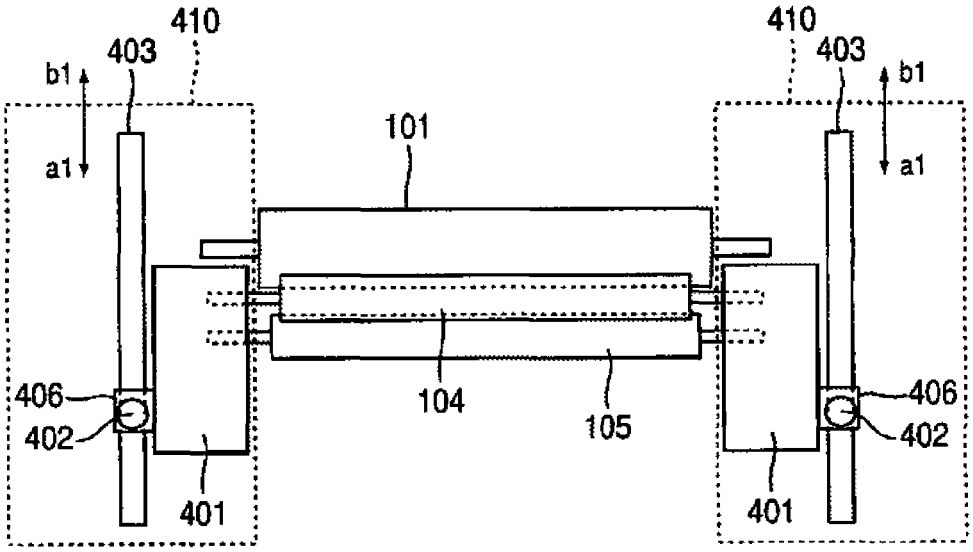
FIG. 6 is a plan view of an image forming unit of the first embodiment.

Here, the structure of development roller pressure changing unit 410 is described referring to FIG. 1 and FIG. 6. FIG. 6 is a plan view of the image forming unit of the first embodiment. Development roller pressure changing units 410 are provided on both end portions of development roller 104 and supplying roller 105. Development roller pressure changing units 410 have the same structure. FIG. 1 is a schematic diagram of the development roller pressure changing unit of the first embodiment, and shows a schematic side view of one of development roller pressure changing units 410 provided on both end portions of development roller 104 and supplying roller 105.

Each development roller pressure changing unit 410 serving as a pressure changing mechanism includes development roller 104, supplying roller 105, unit 401, spring 402, lift-up bar 403, and gears 404 and 405.

Unit 401 serving as a developer carrier supporting member supports development roller 104 and supplying roller 105 in a rotatable manner. Lift-up bar 403 is fixed to unit 401.

Lift-up bar 403 is configured to be slidable in directions indicated by arrows a1 and b1 in the drawing. Protrusion 406 provided at a tip of spring 402 serving as an elastic member is brought into contact with lift-up bar 403, and urges lift-up bar 403 in the direction indicated by arrow b1. Lift-up bar 403 thereby causes development roller 104, supported by unit 401, to be pressed to photosensitive drum 101.

Lift-up bar 403 includes a rack engaged with gear 404. Gear 405 engaged with gear 404 is rotated by unillustrated development roller pressure change driving unit 411 serving as a driving unit. Lift-up bar 403 thereby slides in the directions indicated by arrows a1 and b1 in the drawing.

Accordingly, development roller pressure change driving unit 411 is capable of adjusting the nip amount between development roller 104 and photosensitive drum 101 by adjusting the pressure applied to photosensitive drum 101 by development roller 104. In other words, development roller pressure change driving unit 411 increases the nip amount by increasing the pressure, and decreases the nip amount by decreasing the pressure.

Referring now to FIG. 3, charging roller power source 201 outputs, to charging roller 102, a bias voltage having the same polarity as that of toner. Development roller power source 202 outputs, to development roller 104, a bias voltage having a polarity which is the same as or opposite to that of the toner. Supplying roller power source 203 outputs, to supplying roller 105, a bias voltage having a polarity which is the same as or opposite to that of the toner.

Figure 4:
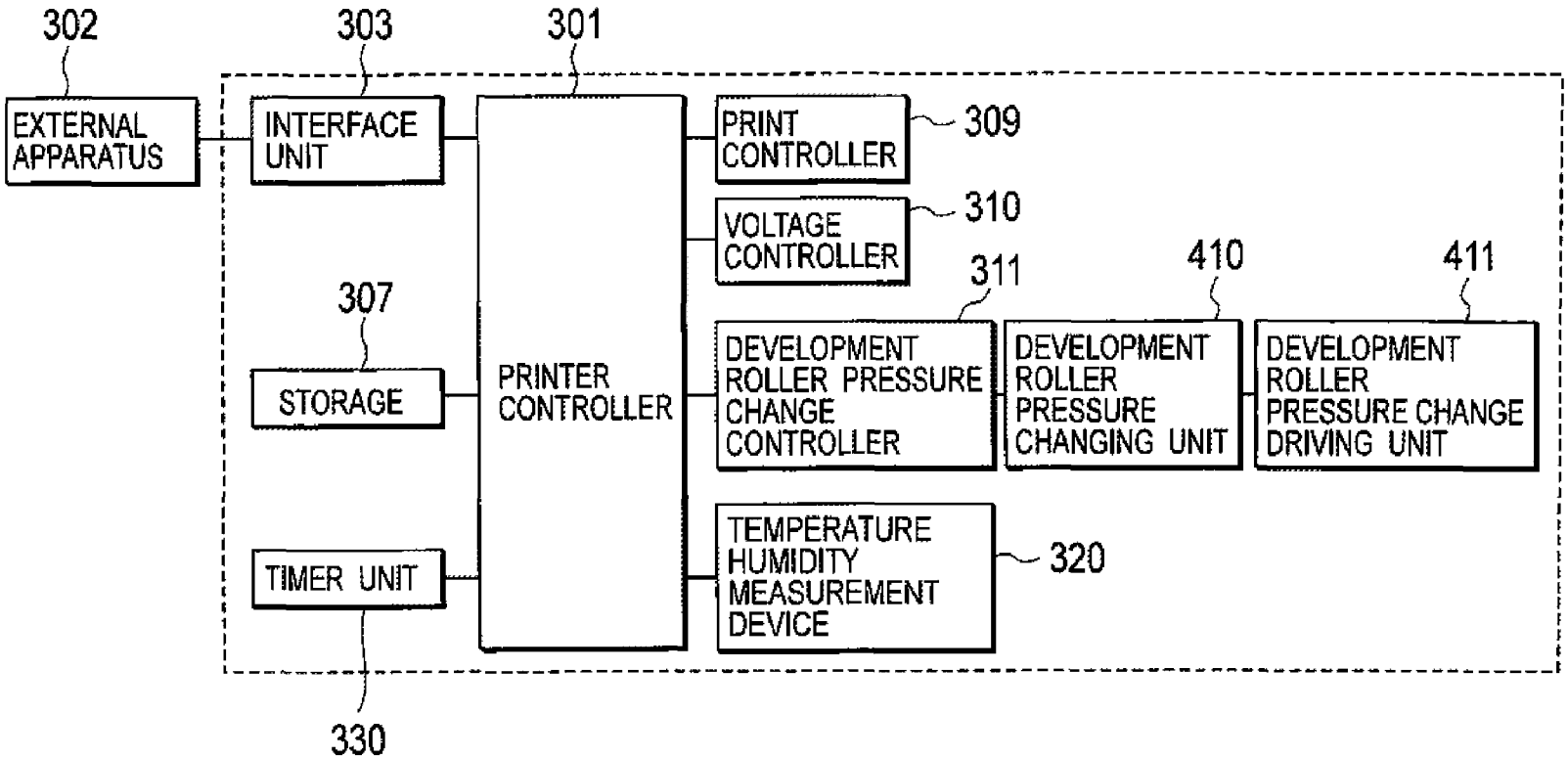
FIG. 4 is a block diagram showing the configuration of a control system of the image forming apparatus of the first embodiment.

Next, a control system of the image forming apparatus is described with reference to FIG. 3 and on the basis of the block diagram of FIG. 4 showing the configuration of a control system of the image forming apparatus of the first embodiment.

As shown in FIG. 4, the image forming apparatus includes printer controller 301, interface unit 303, storage 307, print controller 309, voltage controller 310, development roller pressure change controller 311, temperature humidity measurement device 320, timer unit 330, development roller pressure changing unit 410, and development roller pressure change driving unit 411.

Interface unit 303 receives image data to serve as print data from external apparatus 302 such as a personal computer or a host apparatus.

Print controller 309 controls the rollers of image forming unit 110, exposure unit 103, and the like for performing a printing operation, thereby forming a toner image on the basis of the image data received by interface unit 303 and transferring the toner image onto the recording medium.

Voltage controller 310 controls the ON/OFF switching and values of voltages applied to charging roller 102, development roller 104, supplying roller 105, and the like in image forming unit 110.

Development roller pressure change controller 311 serving as a pressure controller controls the operation of development roller pressure changing unit 410 and controls the pressure applied to photosensitive drum 101 by development roller 104, thereby controlling the nip amount between development roller 104 and photosensitive drum 101. Note that development roller pressure changing unit 410 is driven by development roller pressure change driving unit 411.

Temperature humidity measurement device 320 to temperature humidity measurement unit) is configured to measure the temperature and humidity around image forming unit 110 with sensors or the like. Timer unit 330 is a time measurement unit to measure an elapsed time.

Storage 307 is a storage unit such as a memory, and stores the temperature and humidity measured by temperature humidity measurement device 320, time measured by timer unit 330, threshold values, various setting values, and the like.

Printer controller 301 includes a central processing unit serving as a control and calculation unit, and controls, on the basis of a control program stored in storage 307, the overall operation of the image forming apparatus including interface unit 303, storage 307, print controller 309, voltage controller 310, development roller pressure change controller 311, temperature humidity measurement device 320, timer unit 330, development roller pressure changing unit 410, and development roller pressure change driving unit 411.

Operations of the above-described configuration are now described.

First, the printing operation of the image forming apparatus is described with reference to FIG. 2, FIG. 3 and FIG. 4.

Charging roller 102, connected to charging roller power source 201, uniformly charges the surface of photosensitive drum 101. Image data received from external apparatus 302 is sent to exposure unit 103 through printer controller 301. Exposure unit 103 forms an electrostatic latent image on photosensitive drum 101 based on the image data.

Supplying roller 105, connected to supplying roller power source 203, is in contact with development roller 104 connected to development roller power source 202. Supplying roller 105 and development roller 104 are rotated with the peripheral speed ratio between them kept constant, so that supplying roller 105 feeds toner to development roller 104.

Toner on development roller 104 is triboelectrically-charged with toner regulating member 106 which is in contact with development roller 104, or other members. The thickness of the toner layer on development roller 104 is determined by the voltage applied to development roller 104, the voltage applied to supplying roller 105, the pressure applied to development roller 104 by toner regulating member 106 being in contact therewith, and the like.

Development roller 109 is in contact with photosensitive drum 101. As a result of the voltage applied by power source unit 204 and controlled by voltage controller 310, development roller 104 attaches the toner to the electrostatic latent image formed on photosensitive drum 101. Thereafter, the toner on photosensitive drum 101 is transferred onto recording medium 3 by the electric field formed between photosensitive drum 101 and image transfer member 108. The toner transferred onto recording medium 3 is fixed by fixing unit 7. The untransferred toner remaining on photosensitive drum 101 after image transfer is removed by cleaning device 107.

Figure 7:
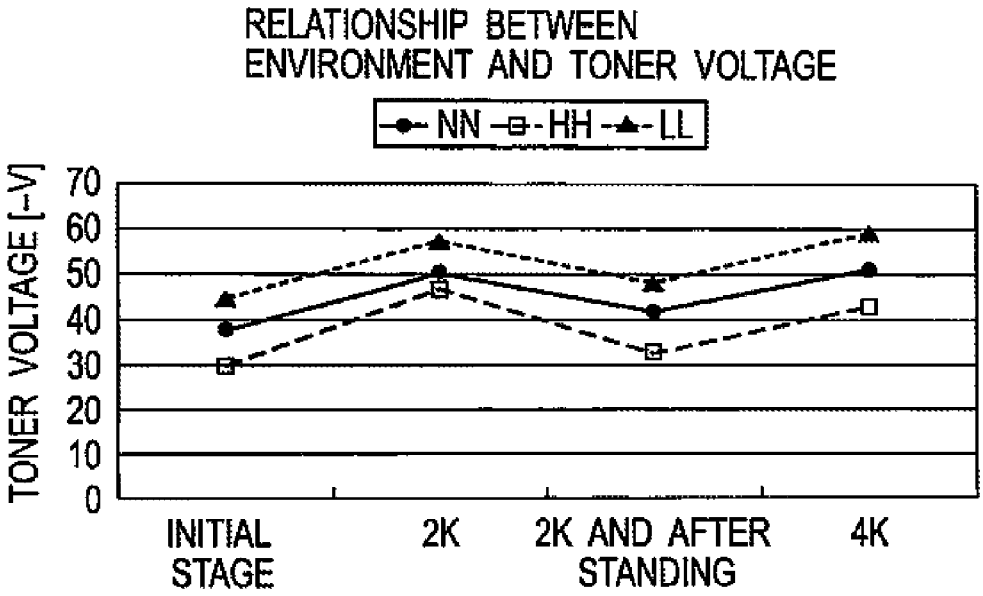
FIG. 7 is a graph showing the relationship between the environment and the toner voltage in the first embodiment.

Next, the toner voltage on the development roller in situations where the printing operation is executed in environments in which temperature and humidity varies is described with reference to FIG. 7 showing the relationship between the environment and the toner voltage in the first embodiment.

FIG. 7 is a graph showing the voltage of toner on development roller 104 in the following cases. Specifically, continuous printing with low toner coverage is executed on A4 recording media in environments labeled NN (temperature: 23° C., humidity: 50%), HH (temperature: 28° C., humidity: 80%), and LL (temperature: 10° C., humidity: 20%). The toner charge is measured before the start of printing at 2K sheets/day and after the completion of printing. In FIG. 7, the "initial stage" on the horizontal axis represents the time point before the start of printing, the "2K" represents the time point at which printing on Day 1 is completed, the "2K and after standing" represents the time point on the day after completion of printing, i.e., before the start of printing on Day 2, and the "4K" represents the time point at which printing on Day 2 is completed. Note that, in the printing operation, the direction of transferring the printing media in the image forming apparatus is the same as the longitudinal direction of the printing media.

As shown in FIG. 7, the voltage of toner on the development roller is higher in the order of environment LL, environment NN, and environment HH. This is explained by the following reasons. In a high-temperature and high-humidity environment such as environment HH, the development roller and the supplying roller absorb moisture, causing an increase in their electrical conductivity, and resulting in charge leakage from the toner. In contrast, in a low-temperature and low-humidity environment such as environment LL, the conductivity of the development roller and the supplying roller decreases, thereby making it difficult for charges on the toner to escape therefrom.

If the toner voltage is too high, the highly charged toner is attached to the photosensitive drum, and then is attached to the printing medium as so-called smear. Conversely, if the toner voltage is low, the proportion of insufficiently charged toner and oppositely charged toner is high. Such toner is attached to the photosensitive drum, and then is attached to the printing medium as so-called fog or background. Both the smear and fog reduce image quality.

In this embodiment, the voltage of toner on development roller 104 is stabilized, thereby preventing smear and fog, and improving image quality.

Hereinafter, details are described with reference to FIG. 1, FIG. 5, and FIG. 6.

A sufficient load is applied by spring 402 to protrusion 406 of development roller pressure changing unit 410, and lift-up bar 403, being in contact with protrusion 406, presses development roller 104 to photosensitive drum 101. Moreover, lift-up bar 403 supports protrusion 406, and thereby keeps the nip amount between development roller 104 to photosensitive drum 101 constant.

A setting in which development roller 104 and photosensitive drum 101 take the positions shown in FIG. 1 is referred to as setting A. In setting A, the nip amount of development roller 104 to photosensitive drum 101 is 0.08 mm.

When gear 405, driven by an unillustrated development roller pressure change driving unit, rotates in the direction indicated by arrow b in the drawing, lift-up bar 403 in the state of setting A is slid in the direction indicated by arrow b1 in the drawing. Lift-up bar 403 has slope 407 formed therein. As lift-up bar 403 slides in the direction indicated by arrow b1, protrusion 406 falls by its own weight and the load applied by spring 402 from the position where protrusion 406 is in contact with slope 407. As a result, protrusion 406 is brought into contact with lift-up bar 403 at the position on flat portion 408, as shown in FIG. 5. As described above, when lift-up bar 403 slides, unit 401 moves in the direction indicated by arrow b2 in the drawing, thereby increasing the nip amount of development roller 104 to photosensitive drum 101.

When protrusion 406 and lift-up bar 403 are brought into contact with each other at the position on flat portion 408, driving of the development roller pressure change driving unit is stopped. A setting in which development roller 104 and photosensitive drum 101 take the positions at this time is referred to as setting B. The nip amount of development roller 104 to photosensitive drum 101 in setting B is 0.12 mm. Note that when lift-up bar 403 slides in the direction indicated by arrow a1 in the drawings, development roller 104 and photosensitive drum 101 return to the positions in setting A.

Figure 8:
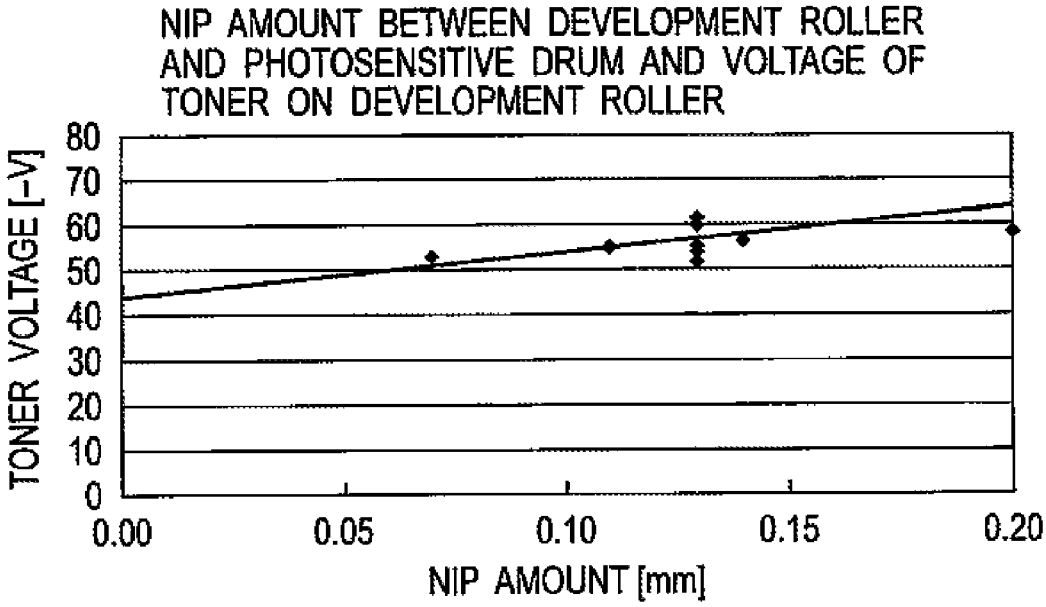
FIG. 8 is a graph showing the relationship between a nip amount and the toner voltage in the first embodiment.

FIG. 8 is a graph showing the relationship between the nip amount between development roller 104 and photosensitive drum 101 and the voltage of toner on development roller 104. As shown in FIG. 8, the nip amount and the toner voltage have a positive correlation, i.e., as the nip amount increases, the voltage of toner on development roller 104 increases.

This is because as the nip amount increases, friction between the toner on development roller 104 and photosensitive drum 101 increases, thereby increasing the amount of charge on the toner on development roller 104.

Figure 9:
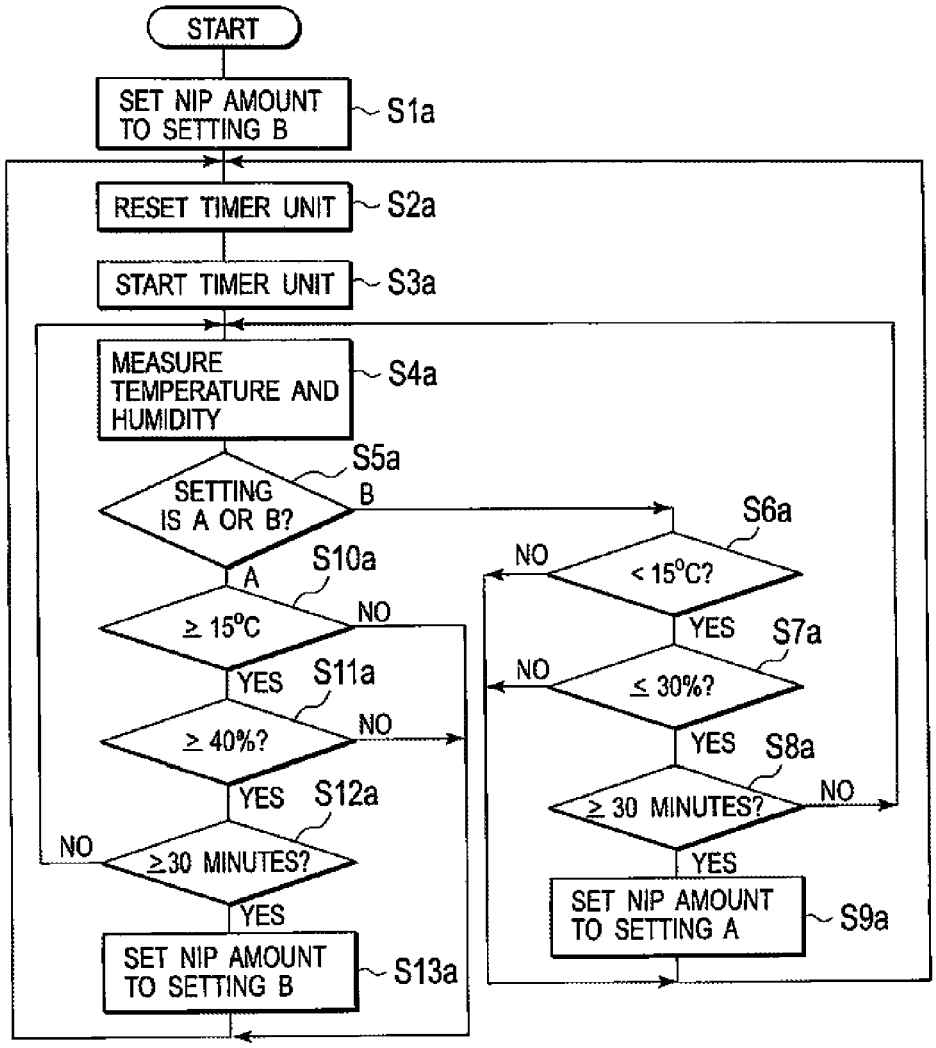
FIG. 9 is a flowchart showing the nip amount setting process in the first embodiment.

Next, the process of setting the nip amount by the printer controller on the basis of steps represented by S's in a flowchart of FIG. 9 is described with reference to FIG. 4.

S1*a*: As an initial stage setting performed after a power source is turned on, printer controller 301 causes development roller pressure change driving unit 411 to slide lift-up bar 403 of development roller pressure changing unit 410, thereby causing the nip amount between development roller 104 and photosensitive drum 101 to be in setting B. In this setting B, the voltage of toner on development roller 104 is high, because the nip amount between development roller 104 and photosensitive drum 101 is large.

S2*a*: Printer controller 301 resets timer unit 330.

S3*a*: Printer controller 301 starts timer unit 330 to measure an elapsed time.

S4*a*: Temperature humidity measurement device 320 measures the temperature and humidity around image forming unit 110, and notifies printer controller 301 of the measured temperature and humidity value. Printer controller 301 stores the notified temperature and humidity value in storage 307.

S5*a*: Printer controller 301 judges whether the current setting of the nip amount is setting A or setting B. When the current setting of the nip amount is judged to be setting A, the processing goes to S10*a*. If the current setting of the nip amount is judged to be setting B, the processing goes to S6*a*. In this embodiment, since the initial setting is setting B, the processing goes to S6*a*.

S6*a*: Printer controller 301 compares the temperature value stored in storage 307 with a threshold stored in storage 307 in advance. If the temperature value is judged to be at or above the threshold, the processing goes to S2*a*. If the temperature value is judged to be less than the threshold, the processing goes to S7*a*. In this embodiment, the threshold is 15° C.

S7*a*: Printer controller 301 compares the humidity value stored in storage 307 with a threshold stored in storage 307 in advance. If the humidity value is judged to be above the threshold, the processing goes to S8*a*. If the humidity value is judged to be less than the threshold, the processing goes to S2*a*. In this embodiment, the threshold is 30%.

S8*a*: Printer controller 301 compares the elapsed time value of timer unit 330 started in S3*a* with a threshold stored in storage 307 in advance. If the elapsed time value is judged to be less than the threshold, the processing goes to S4*a*. If the elapsed time value is judged to be equal to or more than the threshold, the processing goes to S9*a*. In this embodiment, the threshold is 30 minutes.

S9*a*: Printer controller 301 causes development roller pressure change driving unit 411 to slide lift-up bar 403 of development roller pressure changing unit 410, thereby causing the nip amount between development roller 104 and photosensitive drum 101 to be in setting A. Thereafter, the processing goes to S2*a* to execute S2*a* to S5*a*.

The nip amount between development roller 104 and photosensitive drum 101 is caused to be setting A for the following reason. When the temperature and the humidity around image forming unit 110 are judged to be in a low-temperature low-humidity range where the voltage of toner on development roller 104 becomes high, the increase in voltage of the toner on development roller 104 is suppressed by decreasing the nip amount between development roller 104 and photosensitive drum 101.

S10*a*: If a current setting of the nip amount is judged to be setting A in S5*a*, printer controller 301 compares the temperature value stored in storage 307 with a threshold stored in storage 307 in advance. If the temperature value is judged to be less than the threshold, the processing goes to S2*a*. If the temperature value is judged to be at or above the threshold, the processing goes to S11*a*. In this embodiment, the threshold is 15° C.

S11*a*: Printer controller 301 compares the humidity value stored in storage 307 with a threshold stored in storage 307 in advance. If the humidity value is judged to be at or above the threshold, the processing goes to S8*a*. If the humidity value is judged to be less than the threshold, the processing goes to S2*a*. In this embodiment, the threshold is 40%.

Note that the threshold in S7*a* is set to 30%, and the threshold in S11*a* is set to 40% so that change timing of the nip pressure between development roller 104 and photosensitive drum 101 can show hysteresis.

S12*a*: Printer controller 301 compares the elapsed time value of timer unit 330 started in S1*a* with a threshold stored in storage 307 in advance. If the elapsed time value is judged to be less than the threshold, the processing goes to S4*a*. If the elapsed time value is judged to be equal to or more than the threshold, the processing goes to S13*a*. In this embodiment, the threshold is 30 minutes.

S13*a*: Printer controller 301 causes development roller pressure change driving unit 411 to slide lift-up bar 403 of development roller pressure changing unit 410, thereby causing the nip amount between development roller 104 and photosensitive drum 101 to be in setting B. Thereafter, the processing goes to S2*a*.

The nip amount between development roller 104 and photosensitive drum 101 is caused to be in setting B for the following reason. When the temperature and the humidity around image forming unit 110 is judged to be in a high-temperature high-humidity range where the voltage of toner on development roller 104 becomes low, the decrease in voltage of toner on development roller 104 is suppressed by increasing the nip amount between development roller 104 and photosensitive drum 101.

Printer controller 301 changes the nip amount between development roller 104 and photosensitive drum 101 on the basis of temperature and humidity around image forming unit 110, and causes print controller 309 to execute a printing operation on the basis of print data received from external apparatus 302.

As described above, the nip amount between development roller 104 and photosensitive drum 101 can be made to vary on the basis of the temperature and the humidity around image forming unit 110 during image formation. Thereby, the voltage of toner on development roller 104 can be stabilized.

Figures 10, 11:
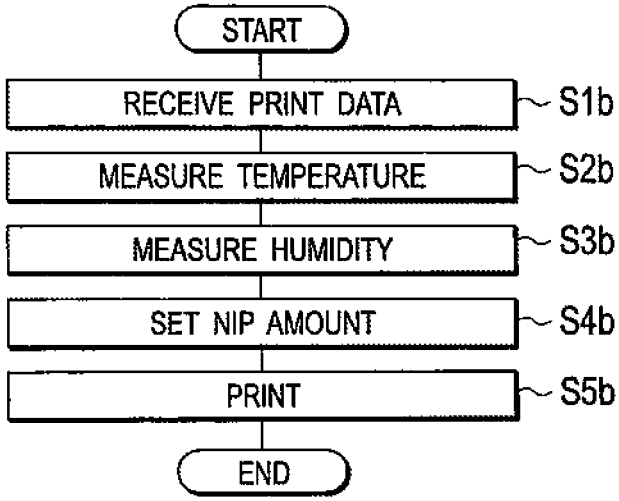
FIG. 10 is a flowchart showing the nip amount setting process in the first embodiment.
FIG. 11 is a diagram for describing the nip amount setting table in the first embodiment.

Next, a modification of the process of setting the nip amount by the printer controller on the basis of steps represented by S's in the flowchart in FIG. 10 is described with reference to FIG. 4.

S1*b*: Printer controller 301 receives print data through interface unit 303 from external apparatus 302.

S2*b* and S3*b*: Temperature humidity measurement device 320 measures the temperature and humidity around image forming unit 110, and notifies printer controller 301 of the measured temperature and humidity value. Printer controller 301 stores the notified temperature and humidity value in storage 307.

S4*b*: Printer controller 301 searches a nip amount setting table based on the temperature humidity value measured by temperature humidity measurement device 320, and extracts a setting (for example, the above-described setting A or setting B) of the nip amount optimum for the temperature value and the humidity value.

The nip amount setting table is, for example, a data table stating as shown in FIG. 11 in which when the humidity is 0% or more but less than 30%, setting A is selected; when the humidity is 30% or more but less than 40%, and the temperature is less than 15° C., setting A is selected; when the humidity is 30% or more but less than 40%, and the temperature is 15° C. or more, setting B is selected; and when a humidity is 40% or more but 100% or less, setting B is selected. For example, when the temperature is 12° C., and the humidity is 20%, setting A is extracted.

Printer controller 301 causes development roller pressure change driving unit 411 to slide lift-up bar 403 of development roller pressure changing unit 410 in accordance with the extracted setting of the nip amount, thereby causing the nip amount to be in setting A or setting B.

Note that when the extracted setting of the nip amount is the same as is already set, the setting is retained. Meanwhile, when the extracted setting of the nip amount is different from that already set, the setting is changed to the extracted setting.

S5*b*: Printer controller 301 sets the nip amount between development roller 104 and photosensitive drum 101 on the basis of the temperature and humidity around image forming unit 110, and causes print controller 309 to execute a printing operation on the basis of the print data received from external apparatus 302.

As described above, the nip amount between development roller 104 and photosensitive drum 101 can be made to vary on the basis of the temperature and humidity around image forming unit 110 during image formation. Thereby, the voltage of toner on development roller 104 can be stabilized.

As described above, in the first embodiment, the nip amount between the development roller and the photosensitive drum is changed on the basis of environmental conditions such as temperature and humidity around the image forming unit. Thereby, the following effects are achieved: the voltage of toner on the development roller can be stabilized; and hence image quality can be improved by preventing fog and smear.

Second Embodiment

An image forming apparatus of a second embodiment has a configuration in which the nip amount between development roller 104 and photosensitive drum 101 can be varied on the basis of printed image density, as well as the environment around the image forming unit.

A control system of the image forming apparatus of the second embodiment is described with reference to FIG. 3 and FIG. 12.

Figure 5:
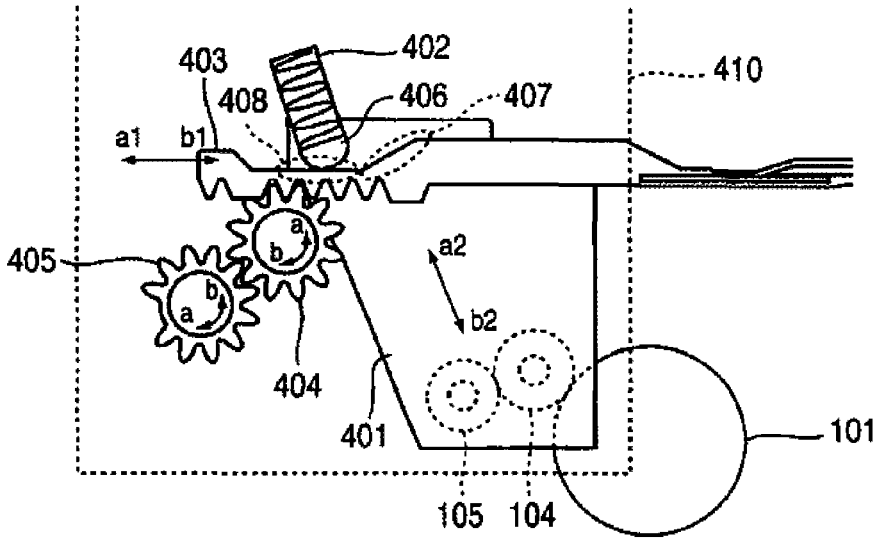
FIG. 5 is a schematic diagram of the development roller pressure changing unit of the first embodiment.

Note that the image forming apparatus, the image forming unit, and the development roller pressure changing unit of this embodiment are the same as the image forming apparatus shown in FIG. 2, the image forming unit shown in FIG. 3, and the development roller pressure changing unit shown in FIG. 1, FIG. 5, and FIG. 6 described in the first embodiment. Therefore, these components are denoted by the same reference numerals, and description thereof is omitted.

Figure 12:
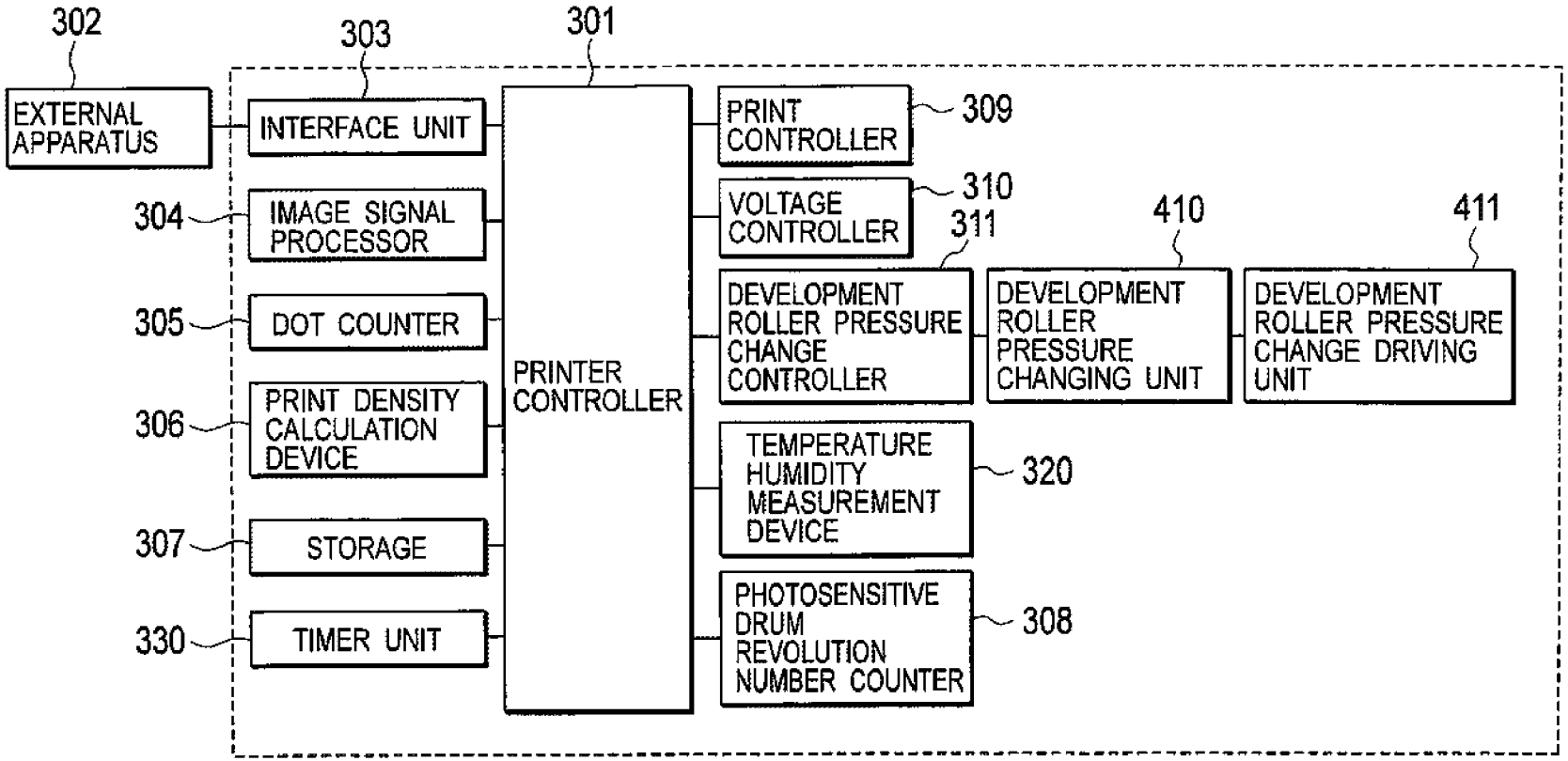
FIG. 12 is a block diagram showing the configuration of a control system of an image forming apparatus of a second embodiment.

As shown in FIG. 12, the image forming apparatus includes printer controller 301, interface unit 303, image signal processor 304, dot counter 305, print density calculation device 306, storage 307, photosensitive drum revolution number counter 308, print controller 309, voltage controller 310, development roller pressure change controller 311, temperature humidity measurement device 320, timer unit 330, development roller pressure changing unit 410, and development roller pressure change driving unit 411.

Interface unit 303 receives image data (print data) from external apparatus 302 such as a personal computer.

Image signal processor 304 converts the image data received by interface unit 303 into dot data, which are print image data.

Dot counter 305 counts the number of dots (pixels) to be printed from the dot data converted by image signal processor 304 The counted number of dots is stored in storage 307.

Print density calculation device 306 serving as a print image density calculation unit reads out the number of dots stored in storage 307, calculates a print image density on the basis of the read-out number of dots, and notifies printer controller 301 of the calculated print image density.

Here, the print image density is a ratio of dots actually printed to dots in printable regions of printing media, and can be calculated from $$[Cm(i)/(Cd \times C0)] \times 100\%,$$

where Cm(i) is the number of dots actually used in printing when the photosensitive drum rotates Cd times, i.e., the number of dots exposed to light by the exposure unit, C0 is the number of dots per revolution of the photosensitive drum, i.e., the number of dots printable per revolution of the photosensitive drum irrespective of the presence or absence of light exposure (for example, the number of dots used in printing a solid image), and Cd×C0 is the number of dots printable when the photosensitive drum rotates Cd-times.

As described above, the print image density is a density found from the number of dots A actually used in image formation in a predetermined area (for example, an area for 100 sheets of printing paper, or for 100 revolutions of the photosensitive drum) and the total number of dots B usable in image formation in the predetermined area (density=the number of dots A/the number of dots B×100%).

Note that the number of dots per revolution of the photosensitive drum is stored in advance in storage 307 described below.

Photosensitive drum revolution number counter 308 serving as a printed-sheet number counting unit counts the number of revolutions of photosensitive drum 101, and notifies printer controller 301 of the counted number of revolutions. Printer controller 301 is capable of calculating the number of printed sheets of printing media on the basis of the counted number of revolutions of photosensitive drum 101. Note that the counted number of revolutions is stored in storage 307.

Print controller 309 executes the following printing operation by controlling the rollers of image forming unit 110, exposure unit 103, and the like. Specifically, print controller 309 forms a toner image on the basis of the dot data obtained by converting, by image signal processor 304, the image data received by interface unit 303. Then, print controller 309 transfers the toner image onto a recording medium.

Voltage controller 310 controls the ON/OFF switching and values of voltages applied to charging roller 102, development roller 104, supplying roller 105, and the like in image forming unit 110.

Development roller pressure change controller 311 controls the operation of development roller pressure changing unit 410, and controls the pressure applied to photosensitive drum 101 by development roller 104, thereby controlling the nip amount between development roller 104 and photosensitive drum 101. Note that development roller pressure changing unit 410 is driven by development roller pressure change driving unit 411.

Temperature humidity measurement device 320 (a temperature humidity measurement unit) is configured to measure the temperature and humidity around image forming unit 110 with sensors or the like. Timer unit 330 is a time measurement unit configured to measure an elapsed time.

Storage 307 is a storage unit such as a memory, and stores the temperature and the humidity measured by temperature humidity measurement device 320, the time measured by timer unit 330, the number of dots counted by dot counter 305, the number of revolutions of photosensitive drum 101 counted by photosensitive drum revolution number counter 308, the thresholds, various setting values, and the like.

Printer controller 301 includes a central processing unit serving as a control and calculation unit, and controls, on the basis of a control program stored in storage 307, the overall operation of the image forming apparatus including interface unit 303, image signal processor 304, dot counter 305, print density calculation device 306, storage 307, photosensitive drum revolution number counter 308, print controller 309, voltage controller 310, development roller pressure change controller 311, temperature humidity measurement device 320, timer unit 330, development roller pressure changing unit 410, and development roller pressure change driving unit 411.

Operations of the above-described configuration are described. Note that the processes of the image forming apparatus are the same as those in the first embodiment, and description thereof is omitted.

The voltage of toner on the development roller in a continuous printing of low toner coverage in environments in which temperature and humidity are varied is described with reference to FIG. 7 showing the relationship between the environment and the toner voltage in the first embodiment.

The fact that the voltage of toner on the development roller varies depending on the environment in which a printing operation is executed is described in the first embodiment. FIG. 7 also show that, in continuous printing with a small consumption of toner, the voltage of toner on the development roller after printing at 2K sheets/day is executed is higher than the voltage of toner on the development roller before printing is started.

Figure 13:
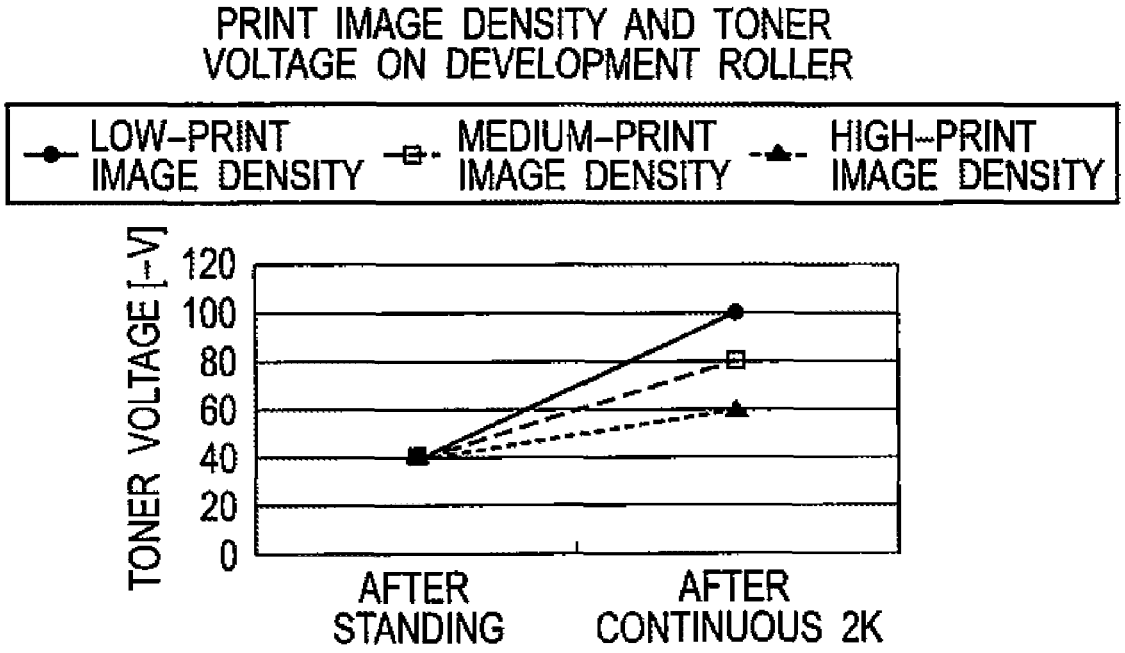
FIG. 13 is a graph showing the relationship between print image density and the toner voltage in the second embodiment.

FIG. 13 is a graph showing the relationship between print image density and the toner voltage in the second embodiment, and showing the voltage of toner on the development roller before a printing operation and after the printing operation in each case where continuous printing is executed at a low-print image density, a medium-print image density, or a high-print image density.

Here, as described above, the print image density is a ratio of dots actually printed relative to dots in printable regions of a printing media. For example, in a case where dots on an entire printable region of a sheet of A4 printing medium are printed, the print image density is 100%, and the print image density is 3% for the low-print image density, 20% for the medium-print image density, and 60% for the high-print image density.

FIG. 13 shows the following: the voltage of toner on the development roller is greatly increased in a continuous printing operation for a print pattern of low-print image density for which toner consumption is small; the voltage of toner on the development roller is slightly increased in a continuous printing operation for a print pattern of high-print image density for which toner consumption is large; and the voltage of toner on the development roller in a continuous printing operation for a print pattern of the middle-print image density is increased to an extent between that of the low-print image density and the high-print image density.

This is because of the following reasons. In the continuous printing operation for the print pattern of low-print image density, most of the toner attached to the development roller is not consumed, and friction of development roller 104 shown in FIG. 3 with other members such as toner supplying roller 105, toner regulating member 106, and photosensitive drum 101 increases the amount of charges on the toner.

Conversely, in the continuous printing operation for the print pattern of high-print image density, toner attached to the development roller is consumed by being transferred onto the photosensitive drum, and fresh toner is supplied and attached to the development roller. As a result, the increase in amount of charges on the toner is small.

The second embodiment is designed to suppress change in voltage of toner on the development roller due to the change in print image density, and thereby retain stable image quality.

Figure 14:
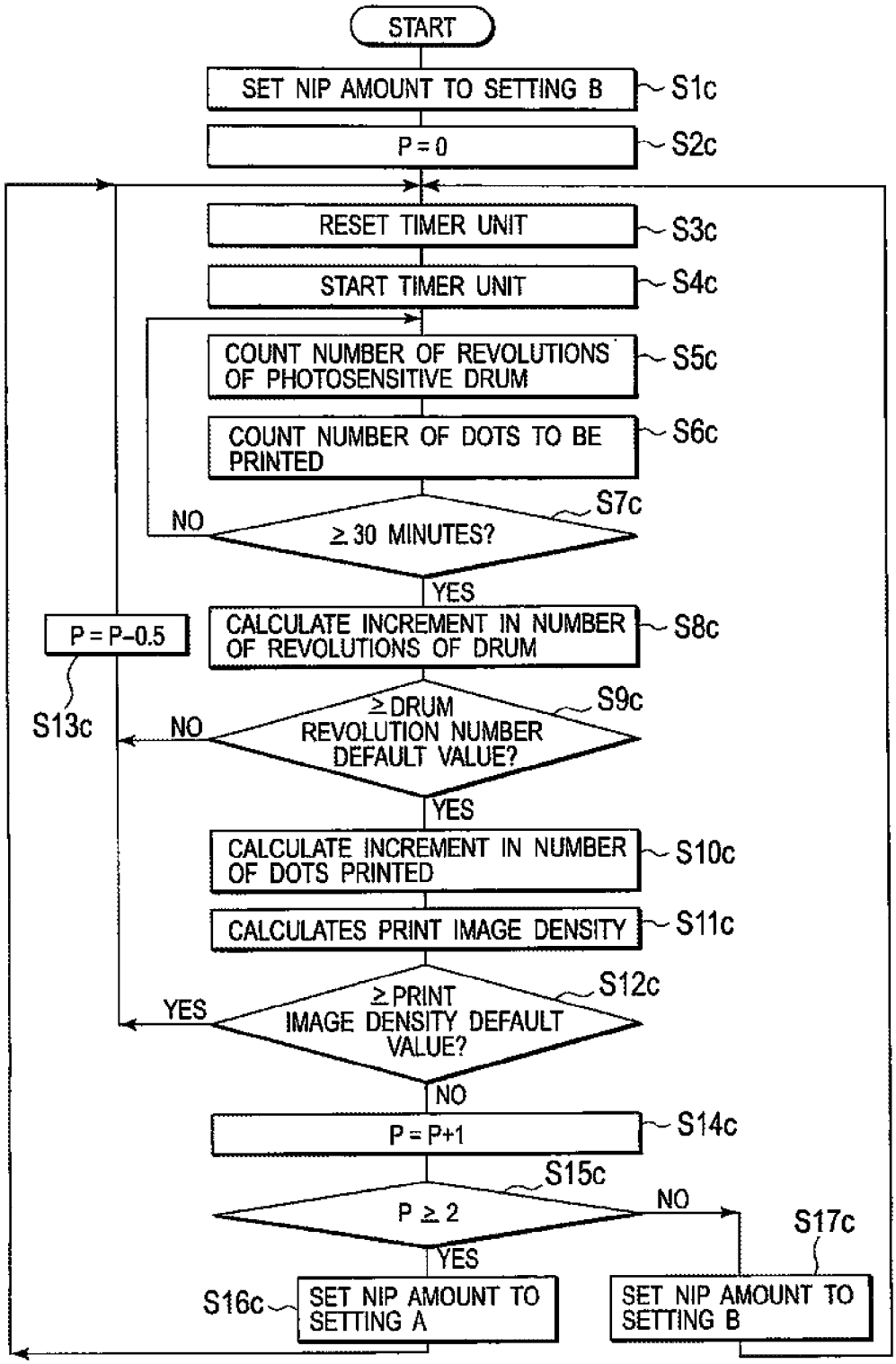
FIG. 14 is a flowchart showing the nip amount setting process in the second embodiment.

Next, a process of setting the nip amount by the printer controller on the basis of steps represented by S's in a flowchart of FIG. 14 is described with reference to FIG. 12.

S1*c*: As an initial stage setting after the power source is turned on, printer controller 301 causes development roller pressure change driving unit 411 to slide lift-up bar 403 of development roller pressure changing unit 410, thereby causing the nip amount between development roller 104 and photosensitive drum 101 to be in setting B. In this setting B, the voltage of toner on development roller 104 is set high, because the nip amount between development roller 104 and photosensitive drum 101 is large.

S2*c*: Printer controller 301 sets parameter P to 0. Note that parameter P is stored in storage 307.

S3*c*: Printer controller 301 resets timer unit 330.

S4*c*: Printer controller 301 starts timer unit 330 to measure an elapsed time.

S5*c*: Photosensitive drum revolution number counter 308 counts the number of revolutions of the photosensitive drum. Printer controller 301 stores the counted number of revolutions in storage 307.

S6*c*: Dot counter 305 counts the number of dots (pixels) to be printed from the dot data converted by image signal processor 304. Printer controller 301 stores the counted number of dots to be printed in storage 307.

S7*c*: Printer controller 301 compares the elapsed time value of timer unit 330 started in S4*c* with a threshold stored in storage 307 in advance. If the elapsed time value is judged to be less than the threshold, the processing goes to S5*c* where the counting of the number of revolutions of the photosensitive drum and the counting of the number of dots to be printed are continued. If the elapsed time value is judged equal to or more than the threshold, the processing goes to S8*c*. In this embodiment, the threshold is 30 minutes.

S8*c*: Printer controller 301 calculates an increment in the number of revolutions of the photosensitive drum from the time point at which timer unit 330 is started in S4*c*, on the basis of the number of revolutions of the photosensitive drum stored in storage 307, and calculates the number of revolutions of the photosensitive drum in a predetermined time period.

S9*c*: Printer controller 301 compares the calculated number of revolutions of the photosensitive drum with a drum revolution number default value, which is a printed-sheet number threshold, stored in storage 307 in advance. If the calculated number of revolutions of the photosensitive drum is judged to be at or above the drum revolution number default value, the processing goes to S10*c*. If the calculated number of revolutions of the photosensitive drum is judged to be less than the drum revolution number default value, the processing goes to S13*c*. In this embodiment, the drum revolution number default value is the number of revolutions of the photosensitive drum corresponding to 100 pages of M printing media.

S10*c*: Printer controller 301 calculates an increment in the number of dots printed after tinier unit 330 is started in S4*c*, on the basis of the number of printed dots stored in storage 307, and calculates the number of printed dots for a case where the number of revolutions of the photosensitive drum in the predetermined time period is at or above the drum revolution number default value.

S11*c*: Printer controller 301 calculates an average print image density per sheet of an A4 printing medium, on the basis of the number of revolutions of the photosensitive drum calculated in S8*c* and on the number of printed dots calculated in S10*c*. The average print image density is calculated on a proportional basis where, for example, if all dots in the printable region of a sheet of an A4 printing medium are printed, the print image density is taken as 100%

S12*c*: Printer controller 301 compares the calculated average print image density with a print image density default value, which is a print image density threshold, stored in storage 307 in advance. If the calculated average print image density is judged to be at or above the print image density default value, the processing goes to S13*c*. If the calculated average print image density is judged to be less than the print image density default value, the processing goes to S14*c*.

S13*c*: Printer controller 301 subtracts 0.5 from parameter P, and then the processing goes to S3*c*. Note that parameter P does not take a value less than 0. If the value of parameter P is 0 before the subtraction, parameter P remains 0.

S14*c*: Meanwhile, if the calculated average print image density is judged to be less than the print image density default value, printer controller 301 adds 1 to parameter P.

S15*c*: Printer controller 301 compares parameter P obtained by the addition with a threshold stored in storage 307 in advance. If parameter P is judged to be at or above the threshold, the processing goes to S16*c*. If parameter P is judged to be less than the threshold, the processing goes to S17*c*. In this embodiment, the threshold is 2.

S16*c*: Printer controller 301 causes development roller pressure change driving unit 411 to slide lift-up bar 403 of development roller pressure changing unit 410, thereby causing the nip amount between development roller 104 and photosensitive drum 101 to be in setting A. Thereafter, the processing goes to S3*c* and is continued.

The nip amount between development roller 104 and photosensitive drum 101 is caused to be in setting A for the following reasons. When a printing operation is executed for a large number of printed sheets at a low print image density, the increase in voltage of toner on development roller 104 is suppressed by decreasing the nip amount between development roller 104 and photosensitive drum 101.

S17*c*: Printer controller 301 causes development roller pressure change driving unit 411 to slide the lift-up bar 403 of development roller pressure changing unit 410, thereby causing the nip amount between development roller 104 and photosensitive drum 101 to be in setting B. Thereafter, the processing goes to S3*c* and is continued.

The nip amount between development roller 104 and photosensitive drum 101 is caused to be in setting B, for the following reason. Specifically, on the basis of an assumption that the voltage of toner on development roller 104 becomes low when a state at a high print image density or with a small number of printed sheets continues for a predetermined time period, the nip amount between development roller 104 and photosensitive drum 101 is increased, thereby suppressing a decrease in voltage of toner on development roller 104.

Printer controller 301 changes the nip amount between development roller 104 and photosensitive drum 101 on the basis of the print image density and the number of printed sheets in a printing operation executed in a predetermined time period, and causes print controller 309 to execute a printing operation on the basis of the print data received from external apparatus 302.

As described above, the nip amount between development roller 104 and photosensitive drum 101 can be varied during image formation on the basis of the print image density and the number of printed sheets in a printing operation performed in a predetermined time period. Thereby, the voltage of toner on development roller 104 can be stabilized.

As described above, in the second embodiment, the nip amount between the development roller and the photosensitive drum is changed on the basis of the number of printed sheets and the print image density. Thereby, the following effects are achieved: the voltage of toner on the development roller can be stabilized, and hence image quality can be improved by preventing fog and smear.

Note that, in the description of each of the first and the second embodiments, the image forming apparatus is a printer. However, the image forming apparatus is not limited thereto, but may be a multifunction printer, a facsimile, a copier, or the like.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

What is claimed is:

1. An image forming apparatus comprising:

an image carrier on which an electrostatic latent image is formed;

a developer carrier being in contact with the image carrier and configured to develop the electrostatic latent image on the image carrier with a developer;

a temperature humidity measurement unit configured to measure temperature and humidity around the developer carrier;

a pressure changing mechanism configured to change a pressure of a contact between the image carrier and the developer carrier; and a pressure controller operable to change, based on the temperature and humidity measured by the temperature humidity measurement unit, the pressure by controlling the pressure changing mechanism, wherein the pressure controller increases the pressure when detecting a high temperature and high humidity condition, and decreases the pressure when detecting a low temperature and low humidity condition.

2. The image forming apparatus according to claim 1, wherein the pressure controller increases the pressure when detecting the high temperature and high humidity condition in which the temperature and the humidity measured by the temperature humidity measurement unit exceed a first temperature threshold and a first humidity threshold both stored in a storage in advance, and decreases the pressure when detecting the low temperature and low humidity condition in which the temperature and the humidity measured by the temperature humidity measurement unit fall below a second temperature threshold and a second humidity threshold both stored in the storage in advance.

3. The image forming apparatus according to claim 2, wherein the first temperature threshold is equal to the second temperature threshold.

4. An image forming apparatus comprising:

an image carrier on which an electrostatic latent image is formed;

a developer carrier being in contact with the image carrier and configured to develop the electrostatic latent image on the image carrier with a developer;

a printed-sheet number counting unit configured to count the number of printed sheets onto which is transferred a developed image developed with the developer by the image carrier;

a print image density calculation unit configured to calculate an average print image density on the printed sheets represented by a ratio of the number of dots printed with the developer to a total number of dots in printable regions in the printed sheets, on the basis of the total number of dots stored in a storage in advance and the counted number of dots printed;

a pressure changing mechanism configured to change a pressure applied to the image carrier by the developer carrier;

a time measurement unit configured to measure an elapsed time; and a pressure controller operable to change the pressure by controlling the pressure changing mechanism on the basis of the number of printed sheets counted by the printed-sheet number counting unit in a predetermined time period measured by the time measurement unit and the average print image density calculated by the print image density calculation unit for the predetermined time period.

5. An image forming apparatus comprising:

an image carrier on which an electrostatic latent image is formed;

a developer carrier in contact with the image carrier and configured to develop the electrostatic latent image on the image carrier with a developer;

a printed-sheet number counting unit configured to count the number of printing media onto which is transferred a developed image developed with the developer by the image carrier;

a print image density calculation unit configured to calculate a print image density represented by a ratio of the number of dots printed with the developer to a total number of dots in printable regions of the printing media, on the basis of the total number of dots stored in a storage in advance and the counted number of dots printed;

a pressure changing mechanism configured to change a pressure applied to the image carrier by the developer carrier;

a time measurement unit configured to measure an elapsed time; and a pressure controller operable to change the pressure by controlling the pressure changing mechanism on the basis of the number of printed sheets counted by the printed-sheet number counting unit in a predetermined time period measured by the time measurement unit and the print image density calculated by the print image density calculation unit for the predetermined time period, wherein the pressure controller decreases the pressure when detecting that the number of printed sheets counted by the printed-sheet number counting unit exceeds a printed-sheet number threshold stored in a storage in advance while the print image density calculated by the print image density calculation unit remains below a print image density threshold stored in a storage in advance, and increases the pressure when detecting that the number of printed sheets exceeds the printed-sheet number threshold stored in the storage in advance while the print image density reaches or exceeds the storage print image density threshold stored in the storage in advance.

6. The image forming apparatus according to claim 1, wherein the pressure changing mechanism includes a developer carrier supporting member configured to be movable while supporting the developer carrier in a rotatable manner, and a driving unit configured to move the developer carrier supporting member, and the pressure changing mechanism changes the pressure applied to the image carrier by the developer carrier by causing the driving unit to move the developer carrier supporting member.

7. The image forming apparatus according to claim 2, wherein the pressure changing mechanism includes a developer carrier supporting member configured to be movable while supporting the developer carrier in a rotatable manner, and a driving unit configured to move the developer carrier supporting member, and the pressure changing mechanism changes the pressure applied to the image carrier by the developer carrier by causing the driving unit to move the developer carrier supporting member.

8. The image forming apparatus according to claim 3, wherein the pressure changing mechanism includes a developer carrier supporting member configured to be movable while supporting the developer carrier in a rotatable manner, and a driving unit configured to move the developer carrier supporting member, and the pressure changing mechanism changes the pressure applied to the image carrier by the developer carrier by causing the driving unit to move the developer carrier supporting member.

9. The image forming apparatus according to claim 4, wherein the pressure changing mechanism includes a developer carrier supporting member configured to be movable while supporting the developer carrier in a rotatable manner, and a driving unit configured to move the developer carrier supporting member, and the pressure changing mechanism changes the pressure applied to the image carrier by the developer carrier by causing the driving unit to move the developer carrier supporting member.

10. The image forming apparatus according to claim 5, wherein the pressure changing mechanism includes a developer carrier supporting member configured to be movable while supporting the developer carrier in a rotatable manner, and a driving unit configured to move the developer carrier supporting member, and the pressure changing mechanism changes the pressure applied to the image carrier by the developer carrier by causing the driving unit to move the developer carrier supporting member.

11. The image forming apparatus according to claim 1 that determines whether the high temperature and high humidity condition or the low temperature and low humidity condition, based on a temperature threshold, a humidity threshold, and the temperature and the humidity measured by the temperature humidity measurement unit.

12. The image forming apparatus according to claim 1 that determines whether the high temperature and high humidity condition or the low temperature and low humidity condition, based on a setting table, and the temperature and the humidity measured by the temperature humidity measurement unit.

* * * * *